US005568083A

United States Patent [19]

Uchiyama et al.

[11] Patent Number: 5,568,083

[45] Date of Patent: Oct. 22, 1996

[54] SEMICONDUCTOR INTEGRATED CIRCUIT DEVICE HAVING AN INTERNALLY PRODUCED OPERATION VOLTAGE MATCHED TO OPERATION SPEED OF CIRCUIT

[75] Inventors: Akira Uchiyama, Kodaira; Ryuji Shibata, Higashiyamato; Yoshinobu Nakagome, Hamura; Masaharu Kubo, Hachiouji, all of Japan

[73] Assignees: Hitachi, Ltd.; Hitachi Microcomputer System Ltd., both of Tokyo, Japan

[21] Appl. No.: 263,720

[22] Filed: Jun. 22, 1994

[30] Foreign Application Priority Data

Jul. 2, 1993 [JP] Japan ..... 5-190890

[51] Int. Cl.[6] ..... G05F 1/10

[52] U.S. Cl. ..... 327/538; 327/536; 331/17

[58] Field of Search ..... 327/156, 157, 327/323, 332, 512, 536, 538, 539, 540, 544, 276, 284, 333; 331/2, 17; 326/81

[56] References Cited

U.S. PATENT DOCUMENTS

| | | | |
|---|---|---|---|
| 4,329,598 | 5/1982 | Welland | 327/540 |
| 4,794,278 | 12/1988 | Vajdic | 327/536 |
| 4,899,071 | 2/1990 | Morales | 327/277 |
| 4,922,141 | 5/1990 | Lofgren et al. | 327/276 |
| 4,988,960 | 1/1991 | Tomisawa | 331/2 |
| 5,094,546 | 3/1992 | Tsuji | 327/512 |
| 5,119,043 | 6/1992 | Borwn et al. | 331/17 |
| 5,138,282 | 8/1992 | Bailey et al. | 331/17 |
| 5,151,665 | 9/1992 | Wentzler | 331/17 |
| 5,309,083 | 5/1994 | Pierret et al. | 327/540 |
| 5,323,071 | 6/1994 | Hirayama | 326/68 |

FOREIGN PATENT DOCUMENTS

| | | |
|---|---|---|
| 2179264 | 7/1990 | Japan . |
| 4162560 | 6/1992 | Japan . |

*Primary Examiner*—Timothy P. Callahan
*Assistant Examiner*—Jung Ho Kim
*Attorney, Agent, or Firm*—Antonelli, Terry, Stout & Kraus

[57] ABSTRACT

The semiconductor integrated circuit device incorporates a power supply circuit which forms an operation voltage that matches the operation speed of the internal circuit. Since the operation voltage is set in accordance with the operation speed required of the internal circuit, the internal circuit can be operated with a minimum required voltage even when there are process variations and temperature changes. In other words, a rational power supply is realized.

9 Claims, 12 Drawing Sheets

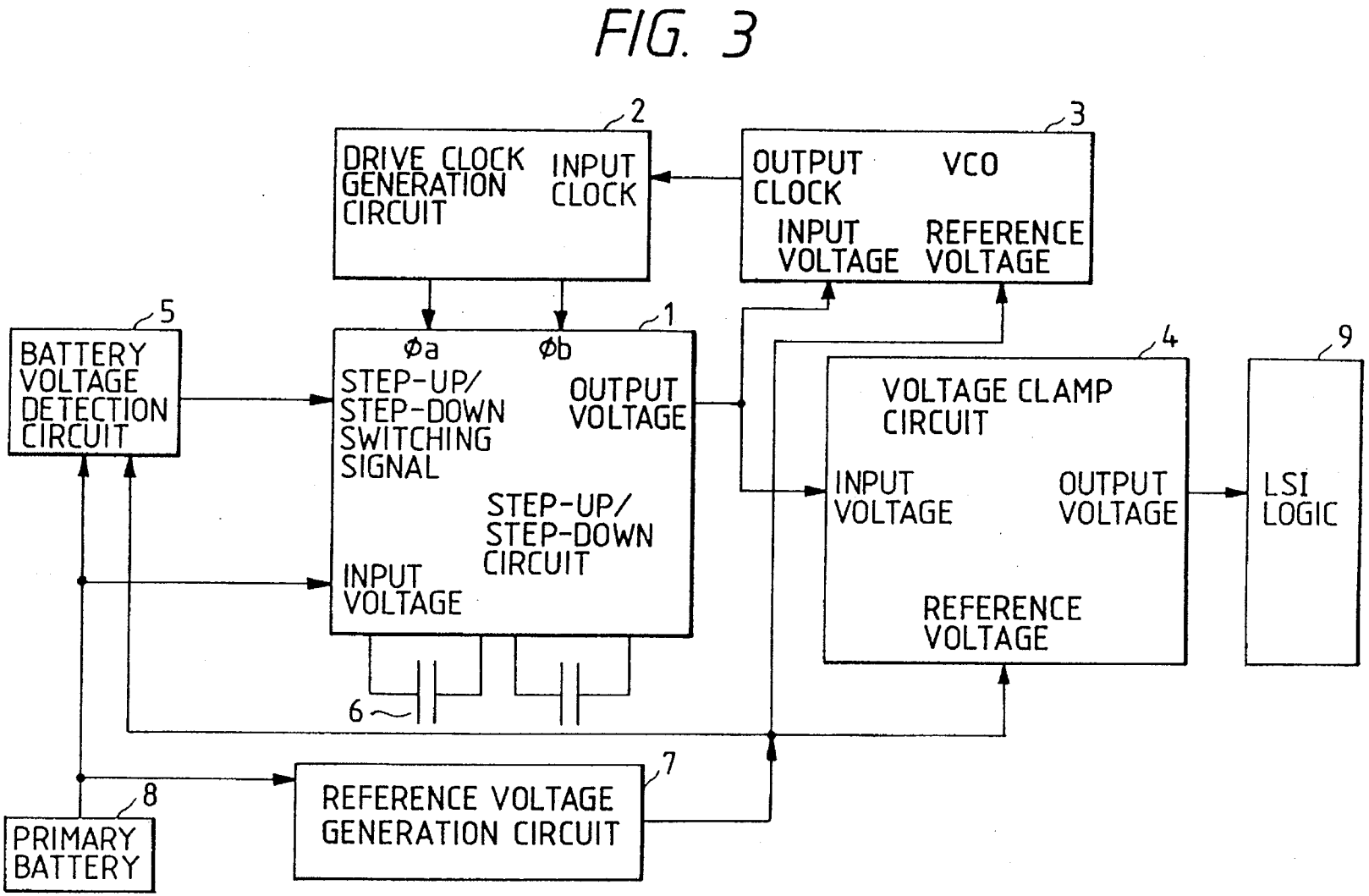
FIG. 3
1
2
3
4
5
6
7
8
9
DRIVE CLOCK GENERATION CIRCUIT
INPUT CLOCK
OUTPUT CLOCK
VCO
INPUT VOLTAGE
REFERENCE VOLTAGE
VOLTAGE CLAMP CIRCUIT
INPUT VOLTAGE
OUTPUT VOLTAGE
REFERENCE VOLTAGE
LSI LOGIC
Φa
STEP-UP/ STEP-DOWN SWITCHING SIGNAL
Φb
OUTPUT VOLTAGE
STEP-UP/ STEP-DOWN CIRCUIT
INPUT VOLTAGE
BATTERY VOLTAGE DETECTION CIRCUIT
REFERENCE VOLTAGE GENERATION CIRCUIT
PRIMARY BATTERY (DURING STEP-UP OPERATION)

(DURING STEP-DOWN OPERATION)

DRIVE CLOCK GENERATION CIRCUIT
INPUT CLOCK
OUTPUT CLOCK
VCO
INPUT VOLTAGE
OUTPUT VOLTAGE
STEP-UP/ STEP-DOWN SWITCHING SIGNAL
STEP-UP/ STEP-DOWN CIRCUIT
INPUT VOLTAGE
VOLTAGE FOLLOWER
OP
LSI LOGIC
BATTERY VOLTAGE DETECTION CIRCUIT
PRIMARY BATTERY
LPF
MODEL DELAYING PATH
PHASE DETECTION CIRCUIT
ORIGINAL OSCILLATION
ORIGINAL OSCILLATION
1
2
3
5
6
8
9
10
11
12
14

DEPENDENCY ON AMBIENT TEMPERATURE AND POWER SUPPLY VOLTAGE OF THE MODEL DELAY PATH'S DELAY TIME

DEPENDENCY ON AMBIENT TEMPERATURE AND POWER SUPPLY VOLTAGE OF THE OPERATION FREQUENCY

SEMICONDUCTOR INTEGRATED CIRCUIT DEVICE HAVING AN INTERNALLY PRODUCED OPERATION VOLTAGE MATCHED TO OPERATION SPEED OF CIRCUIT

BACKGROUND OF THE INVENTION

The present invention relates to a semiconductor integrated circuit device and a method of supplying power thereto and, more specifically, to a technology suitably applied to, for example, a battery-driven semiconductor integrated circuit device and a method of supplying power to it.

The power supply voltage for the semiconductor integrated circuit devices normally is 5 V for transistor-transistor logic (TTL) and complementary type MOS (CMOS). International interface specifications for CMOS circuits considering operations based on low-voltage power are shown in JEDEC STANDARD No. 8 and include a low voltage CMOS (LVCMOS) and a low voltage battery operated CMOS (LVBOCMOS).

SUMMARY OF THE INVENTION

Semiconductor integrated circuits composed of MOSFETs (insulated gate field-effect transistors) have a drawback that their operation speeds change because of their relatively large process variations and also by temperature variations. As to the semiconductor circuits composed of CMOSs, the current consumption increases in proportion to the operation speeds. In other words, the variations in operation speed are closely related to the variations in the current consumption.

The present inventors have found that it is possible to control the operation voltage of the semiconductor integrated circuit, composed of MOSFETs, in accordance with such process variations and temperature changes. That is, rather than fixedly setting the operation voltage of the semiconductor integrated circuit according to interfaces, a power supply voltage that will result in a desired operation speed is internally produced to compensate for the process variations and temperature changes, thereby driving the semiconductor integrated circuit with a minimum required power.

An object of this invention is to provide a semiconductor integrated circuit device that realizes a rational supply of power in accordance with process variations and temperature changes and a method of supplying power to the device.

Another object of this invention is to provide a semiconductor integrated circuit device that realizes a virtual reduction in power consumption and a method of supplying power to the device.

Still another object of this invention is to provide a semiconductor integrated circuit device that is capable of prolonging the battery life and a method of supplying power to the device.

These and other objects and novel features of this invention will become apparent from the following description of this specification and the accompanying drawings.

Representative aspects of this invention may be briefly summarized as follows. That is, the semiconductor integrated circuit device of this invention incorporates a power supply circuit that produces an operation voltage according to the operation speed of the internal circuit.

With such a means, because the operation voltage is set according to the operation speed required of the internal circuit, the internal circuit can be operated with a minimum required voltage under the conditions of process variations and temperature changes, thus realizing a rational supply of power.

BRIEF DESCRIPTION OF THE DRAWINGS

FIG. 3 is a block diagram showing one embodiment of a power supply circuit built into the semiconductor integrated circuit device of this invention;

DETAILED DESCRIPTION OF THE PREFERRED EMBODIMENTS

Figure 1:
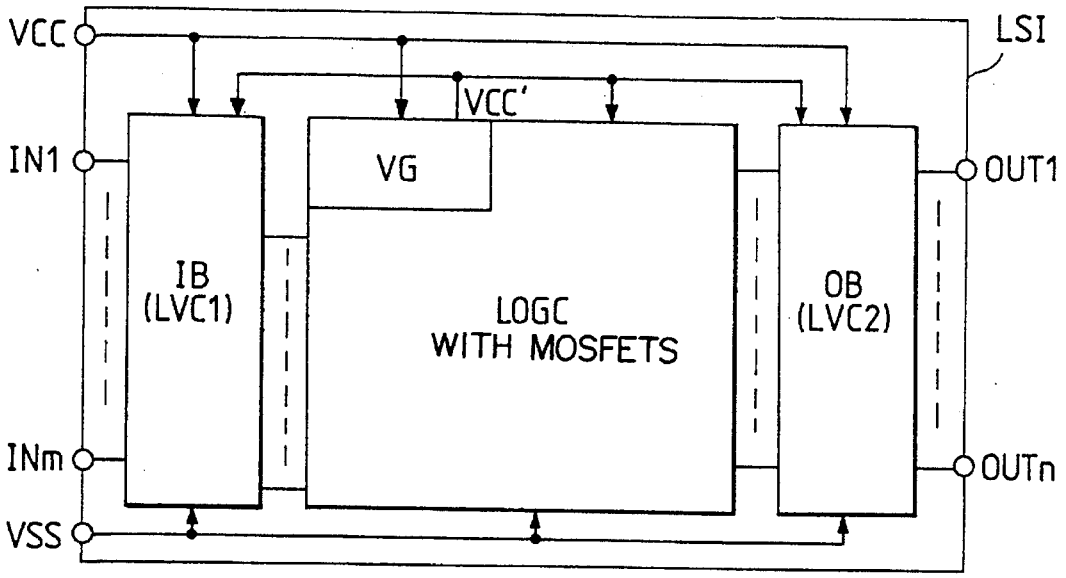
FIG. 1 is an outline block diagram of the semiconductor integrated circuit device as one embodiment of this invention.

FIG. 1 shows an outline block diagram of the semiconductor integrated circuit device as one embodiment of this invention. Each of the circuit blocks in this diagram is formed on a single semiconductor substrate such as a monocrystalline silicon by a known MOS integrated circuit fabrication technique.

An input buffer IB and an output buffer OB are operated by an external power supply voltage VCC and also work as level conversion circuits LVC1, LVC2 that perform level conversion between the signal level of the system side and that of an internal circuit LOGC described next, so that the semiconductor integrated circuit device is compatible with the interface of the system in which the device is incorporated. In other words, in a plurality of semiconductor integrated circuit devices making up a system, the input buffer IB and output buffer OB having such a level conversion function are laid out at the input portion and the output portion for signal transfer so that the external side of the semiconductor integrated circuit device has a common signal level corresponding to the system's power supply voltage VCC.

The internal circuit LOGC (including the LSI logic 9 in FIG. 3) on the other hand is operated by the voltage generated by the built-in (internal) power supply circuit VG. The operation voltage of the internal circuit LOGC is a minimum voltage that matches the operation speed required of the internal circuit LOGC. The internal circuit LOGC has a relatively wide range of operation speed resulting from process variations in the threshold voltage of MOSFETs that make up the internal circuit. Because a MOSFET's conductance characteristic has a positive temperature dependency, i.e. it decreases with increasing temperatures, the operation speed is reduced as the temperature rises. To perform the above-mentioned level conversion, the input buffer IB and the output buffer OB are supplied the power supply voltage VCC (external or system power supply voltage) and a voltage VCC' generated by the built-in power supply circuit VG.

In conventional circuit design schemes, the determination of the size and other features of the MOSFETs requires also giving consideration to the process variations of the MOSFETs and the reduction in speed caused by temperature increase. For this reason, the circuit design must maintain a sufficient margin for the required operation speed. This necessarily results in a circuit having an operation speed much faster than is necessary. Because the current consumption increases generally in proportion to the operation speed, the power consumption necessarily increases.

With this embodiment, on the contrary, the operation voltage for the internal circuit LOGC is generated by the built-in power supply circuit VG in accordance with the required operation speed, so that a minimum required voltage that compensates for the process variations and temperature changes can be produced. As a result, the internal circuit LOGC is operated at an almost constant speed, not affected by the process variations or temperature changes, leading virtually to lower power consumption.

In the example circuit of FIG. 1, if it is formed of CMOS, the input buffer may be operated by the internal voltage generated by the built-in power supply circuit VG to perform a level conversion operation that produces a signal level corresponding to the internal circuit LOGC.

Figure 2:
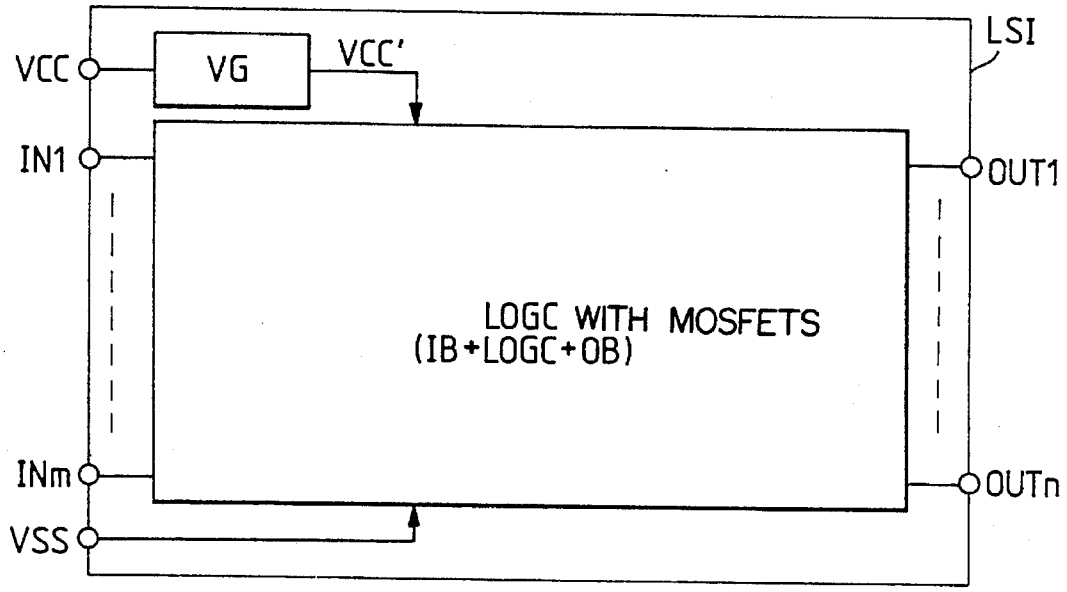
FIG. 2 is an outline block diagram of the semiconductor integrated circuit device as another embodiment of this invention.

FIG. 2 shows an outline block diagram of another embodiment of the semiconductor integrated circuit device according to this invention. The semiconductor integrated circuit device in the figure constitutes a system like a one-chip microcomputer. In the semiconductor integrated circuit device that does not require signal transfers with other semiconductor integrated circuit devices, the input buffer IB and the output buffer OB both can be operated by the internal voltage generated by the built-in power supply circuit VG.

In the output buffer OB, however, circuits such as those that drive a liquid crystal display device need to be provided with a separate power supply circuit other than that used for the internal circuit LOGC to produce a signal for liquid crystal driving or to be operated by the external power supply voltage VCC.

FIG. 3 shows a block diagram of one embodiment of the power supply circuit incorporated in the semi-conductor integrated circuit device of this invention. This embodiment produces the power supply voltage by a primary battery. In the figure, the circuit blocks except for the primary battery 8 and the pair of capacitors 6 with relatively large capacitance are formed on a single semiconductor substrate as an internal circuit along with the LSI logic 9.

The battery voltage of the primary battery 8 is supplied to a battery voltage detection circuit 5 and a reference voltage generation circuit 7. The battery voltage detection circuit 5 compares the reference voltage, which corresponds to the output voltage supplied to the LSI logic 9, with the battery voltage to produce a step-up/step-down switching signal. In this embodiment, in order to elongate the life of the primary battery, in other words, to expand the range of use of the primary battery, the battery voltage detection circuit 5 monitors the voltage of the primary battery and, when the primary battery voltage is sufficiently high for producing the output voltage, specifies the step-down and, when it is too low to produce the output voltage, specifies the step-up.

The step-up/step-down circuit 1 is so configured as to allow switching between a two-times step-up circuit and a harbor circuit 1 which executes a step-down operation. In response to the step-up/step-down switching signal, the step-up/step-down circuit 1 performs the step-up and step-down operation with the battery voltage of the primary battery 8 as an input voltage. A drive clock generation circuit 2 generates two phases of clock pulses $\phi a$, $\phi b$ required for the step-up and step-down operations. These two phases of clock pulses $\phi a$, $\phi b$ are non-overlapping clock pulses whose active levels do not overlap, allowing for efficient step-up and step-down operations.

A voltage clamp circuit 4 performs voltage clamping to make the output voltage constant according to the reference voltage. The voltage clamping can eliminate ripple components in the output voltage generated during the step-up/step-down operations. However, when the load current of the LSI logic 9, which works as a load, is small, the output voltage can be made almost constant by the feedback utilizing a voltage-controlled oscillation circuit (hereinafter referred to also as VCO) 3 and the drive clock generation circuit 2. In that case, the voltage clamp circuit 4 can be omitted.

As the operation current of the LSI logic 9, which is a load, increases, the output voltage of the step-up/step-down circuit 1, which performs the step-up/step-down operation using the charge pump action of the capacitor, decreases. For this reason, although the voltage clamp circuit 4 is provided, because its input voltage itself decreases, the operation voltage of the LSI logic 9 also reduces.

To deal with this problem, it may be possible to set the clock pulse frequency of the step-up/step-down circuit 1 at high values corresponding to the maximum load current of the LSI logic 9. With this method, however, when the operation current of the LSI logic 9 is small, the operation frequencies of the VCO 3, the drive clock generation circuit 2 and the step-up/step-down circuit 1 are set unnecessarily high, resulting in an increased current consumption.

In this embodiment, the current supply capability of the step-up/step-down circuit 1 is controlled according to the current consumption of the LSI logic 9, which is a load. That is, the output voltage of the step-up/step-down circuit 1 and the reference voltage are fed to the VCO (voltage-controlled oscillation circuit) 3, which is controlled to increase the oscillation frequency according to the difference between the reference voltage and the input voltage. With this configuration, because the step-up/step-down circuit 1, the drive clock generation circuit 2 and VCO 3—of which the latter two are the control circuits for the step-up/step-down circuit 1—are operated in response to the frequency that corresponds to the load current flowing in the LSI logic 9, it is possible to set the current consumption at the minimum required level.

Each of the capacitors 6 may utilize a high-dielectric film or ferrodielectric film as its dielectric so that it can be built into the semiconductor integrated circuit. The ferrodielectric film used in the capacitors 6 includes PZT ($PbZr_{1-x}Ti_xO_3$), PLZT ($Pb_{1-x}La_xZr_{1-y}Ti_yO_3$) and bulk BTO ($BaTiO_3$). The ferrodielectric is also a high-dielectric. Examples of high-dielectric, which are normal-dielectric materials with no spontaneous polarization, include BTO (only thin film), BST ($BA_{1-x}$, $Sr_xTiO_3$) and STO ($SrTiO_3$). These high-dielectrics all take a crystal structure called a perovskite.

Figure 4:
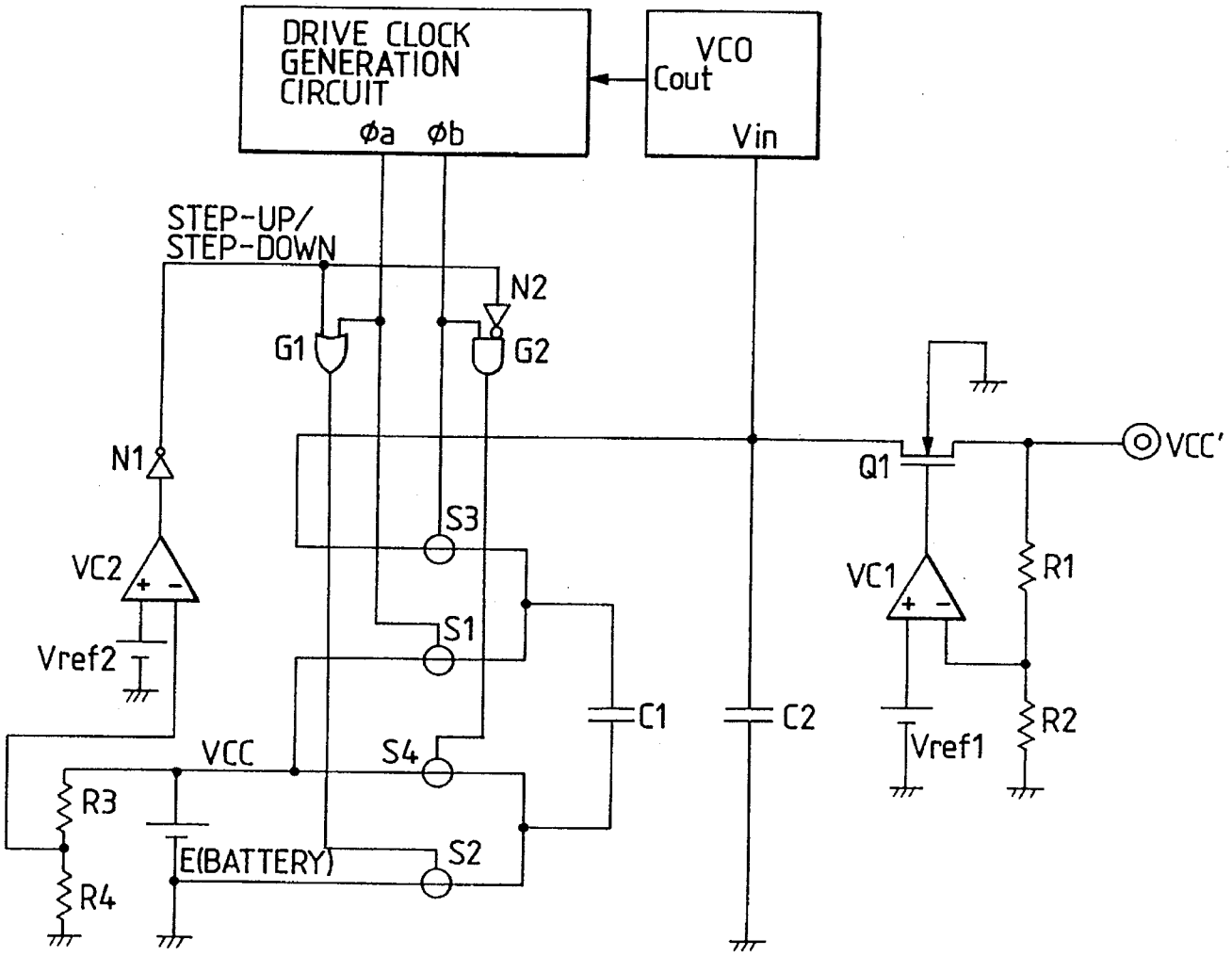
FIG. 4 is a block diagram showing another embodiment of a power supply circuit built into the semiconductor integrated circuit device of this invention.

FIG. 4 shows one example circuitry of the power supply circuit built into the semiconductor integrated circuit device of this invention. The voltage VCC of the battery E is divided by the dividing resistors R3, R4 and supplied to one of the inputs of a voltage comparison circuit VC2 that forms the battery voltage detection circuit. A reference voltage Vref2 is fed to the other input (+) of the voltage comparison circuit VC2. The output signal of the voltage comparison circuit VC2 is supplied through an inverter circuit N1 to the step-up/step-down circuit as the step-up/step-down switching signal.

The step-up/step-down circuit consists of switches S1–S4, capacitors C1, C2, logic gates G1, G2, and an inverter circuit N2. The switches S1–S4 may be formed of CMOS switches. Hence, the switches S1–S4 marked with circles "○" are comprised of parallelly arranged p- and n-channel MOSFETs and an inverter circuit that forms a control voltage supplied to the gate of the p-channel MOSFET.

The OR gate circuit G1, the AND gate circuit G2 and the inverter circuit N2 connected to one of the inputs of the AND gate G2, in response to the switching signal, operate the four switches S1–S4 to make the supply path for the two phases of clock pulses $\phi a$, $\phi b$ formed by the drive clock generation circuit a two-times step-up circuit during the step-up operation and a harbor circuit during the step-down operation.

Figure 5A:
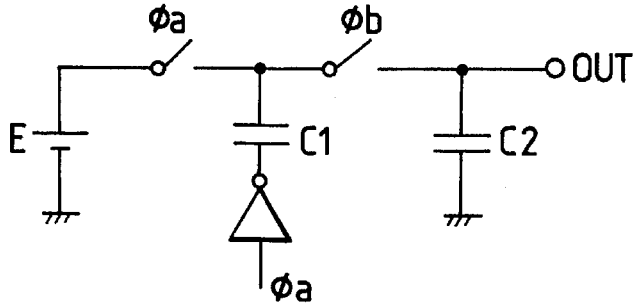
FIGS. 5(A) and 5(B) are equivalent circuits of a step-up/step-down circuit included in the power supply circuit.
Figure 5B:
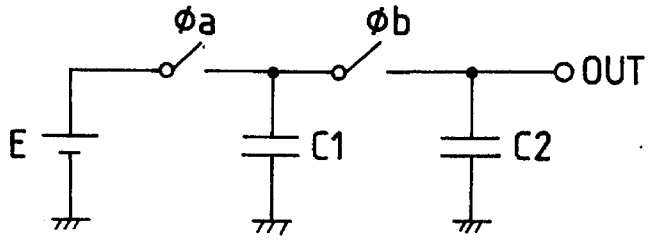

FIG. 5 shows an equivalent circuit of the above-mentioned step-up/step-down circuit, FIG. 5(A) illustrating the equivalent circuit during the step-up operation and FIG. 5(B) the equivalent circuit during the step-down operation. During the step-up operation, as shown in the equivalent circuit (A), the capacitor C1 is charged by the battery E while one of the clock pulses $\phi a$ is high. When the clock pulse $\phi a$ becomes low, the output of the inverter circuit goes high and is added to the holding voltage of the capacitor C1, forming the two-times step-up voltage. When the clock pulse $\phi b$ goes high, the step-up voltage of the capacitor C1 is transferred to the capacitor C2, thus producing the step-up voltage almost two times the original voltage. In the above circuit of FIG. 4, the low level and the high level are given by the switches S2 and S4 in place of the inverter circuit.

During the step-down operation, as shown in the equivalent circuit (B), the capacitor C1 is charged through a switch that is turned on by the clock pulse $\phi a$. When the clock pulse $\phi b$ turns on another switch, the capacitors C1 and C2 are connected in parallel, sharing the electric charge to step down the voltage according to the ratio of their capacitances.

In FIG. 4, when the divided voltage of the battery voltage VCC is higher than the reference voltage Vref2, the output signal of the inverter circuit N1 is held high, causing the output signal of the OR gate circuit G1 to go high turning on the switch S2. As the output signal of the inverter circuit N2 is held low, the output signal of the AND gate circuit G2 becomes low, turning off the switch S4. As a result, the clock pulses $\phi a$ and $\phi b$ operate the switches S1 and S3 alternately, thus forming the harbor circuit as shown in FIG. 5(B).

In FIG. 4, when the divided voltage of the battery voltage VCC becomes lower than the reference voltage Vref2, the output signal of the inverter circuit N1 is held low, causing the output signal of the OR gate circuit G1 to change according to the clock pulse $\phi a$. Because the battery voltage detection signal holds the output signal of the inverter circuit N2 high, the output of the AND gate circuit G2 changes according to the clock pulse $\phi b$. As a result, during the period that the clock pulse $\phi a$ is high, the switches S1 and S2 are turned on charging the capacitor C1. During the period when the clock pulse $\phi b$ is high, the switches S3 and S4 are turned on transferring the battery voltage VCC through the turned-on switch S4 to the capacitor C1, so that the two-times step-up voltage, which is the holding voltage of the capacitor C1 added with the battery voltage VCC, is transferred through the switch S3 to the capacitor C2. In this way, the two-times step-up circuit as shown in FIG. 5(A) is formed.

In FIG. 4, the output voltage of the step-up/step-down circuit is provided across the capacitor C2. This output voltage is made a constant voltage by the voltage clamp circuit, which consists of a voltage comparison circuit VC1, a MOSFET Q operating as a variable resistance element and a voltage division circuit consisting of series-connected resistors R1 and R2. One (+) of the inputs of the voltage comparison circuit VC1 is supplied with a reference voltage Vref1 and the other input (–) with the output voltage VCC' divided by the resistors R1, R2. The voltage comparison circuit VC1 forms an output voltage such that the divided voltage from the resistors R1, R2 matches the reference voltage Vref1 to control the on-resistance value of the MOSFET Q1, thereby producing the regulated output voltage VCC'.

In this embodiment, for reduced power consumption a variable frequency signal formed by the VCO is supplied to the drive clock generation circuit in order to generate a power supply voltage required for the operation of the internal circuit. The VCO changes the oscillation frequency according to the changes in the output voltage of the step-up/step-down circuit to control the output voltage at an almost constant value. Though not shown in the figure, a reference voltage is provided so that a control can be performed to increase the frequency according to the difference between the reference voltage and the output voltage, making it possible to supply current in correspondence with the load current.

Figure 7:
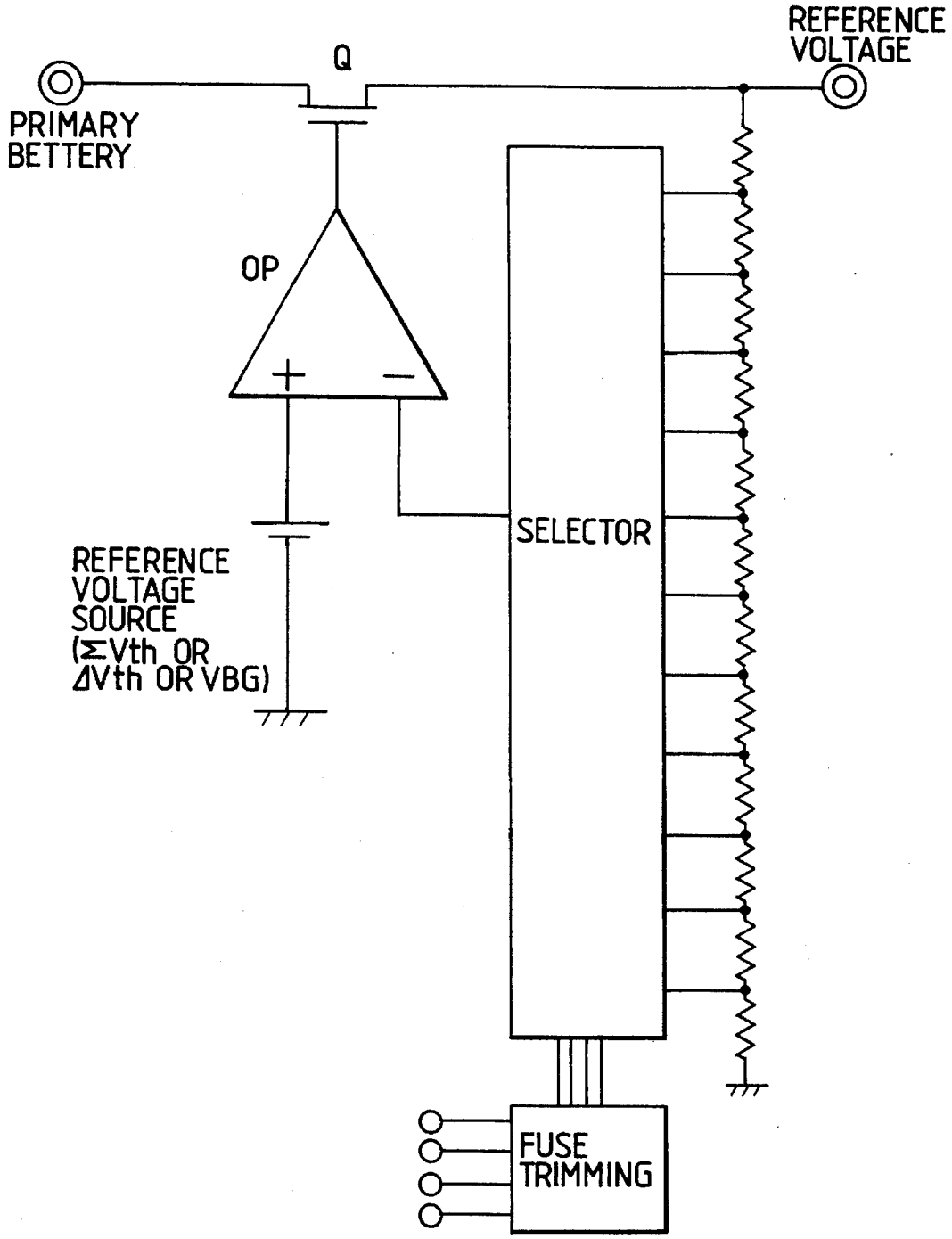
FIG. 7 is a block diagram showing one embodiment of the reference voltage generation circuit used in this invention.

FIG. 7 shows a block diagram of an example reference voltage generation circuit used in this invention. This embodiment is intended for a circuit to form the reference voltage Vref1 supplied to the voltage comparison circuit VC1 that comprises the voltage clamp circuit in FIG. 4.

In this reference voltage generation circuit, an operational amplifier (or voltage comparison circuit) OP compares the voltage of the reference voltage source with a voltage, which is produced by dividing the output reference voltage by a series resistor circuit and a selector, to control the MOSFET Q, a variable resistance element, and thereby to produce a desired reference voltage. When the reference voltage source uses a silicon band gap voltage and a threshold voltage difference of MOSFETs ΔVth, both of which have no temperature dependency, the output reference voltage also has no temperature dependency.

The selector is controlled by a fuse trimming circuit. By selective cutting of the fuse circuit to choose one of divided voltages, into which the reference voltage output through the selector is divided by the series resistor circuit, a desired reference voltage is obtained. Such fuse trimming allows setting of an operation voltage of the LSI logic according to the process variations of the semiconductor integrated circuit.

Figure 6:
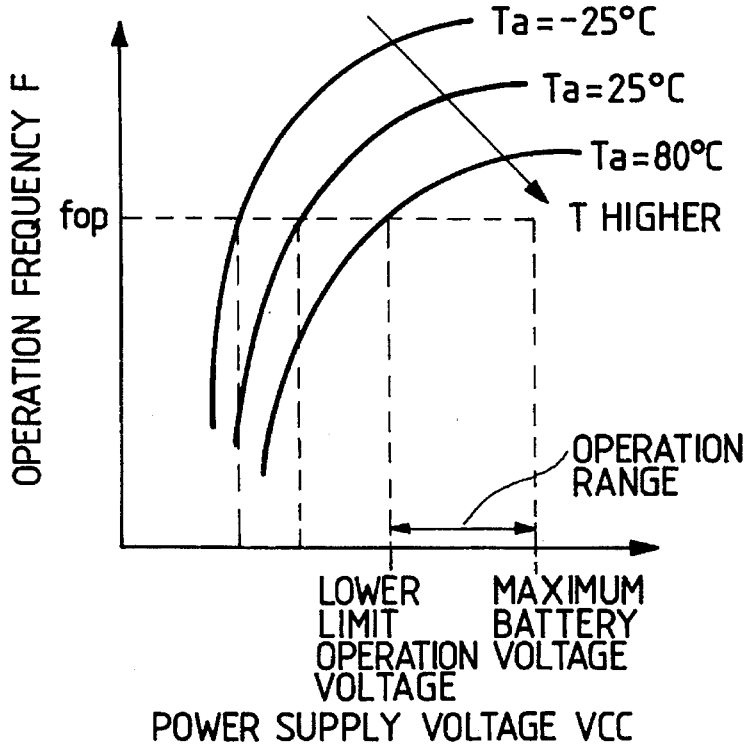
FIG. 6 is a characteristic diagram showing the relation between the operation voltage and the operation frequency with a temperature ta as a parameter in the CMOS integrated circuit.

FIG. 6 shows a characteristic diagram showing the relation between the operation voltage and the operation frequency in the CMOS integrated circuit with the temperature Ta taken as a parameter. The diagram represents cases of temperatures Ta=−25° C., Ta=25° C. and Ta=80° C. In the high-temperature probing at Ta=80° C., a measurement is taken of a lower limit operation voltage that corresponds to the operation frequency fop required of the LSI logic. In this case, the reference voltage source employs the silicon band gap voltage VBG and ΔVth, both of which are not temperature-dependent. In this high-temperature probing, a signal that simulates the same state as the fuse cutting is supplied to the probe pad provided in the fuse trimming circuit to determine the reference voltage that produces the desired operation frequency fop and to blow the fuse accordingly. The fuse cutting is achieved either by supplying an electric current through the polysilicon layer or by emitting an energy beam such as a laser beam.

If the reference voltage for the voltage clamp corresponding to the process variations is set by such a high-temperature probing to produce the operation voltage of the LSI logic, when the LSI logic operates on the system and its temperature rises, the operation frequency does not fall below the required operation frequency fop. Thus, the required operation frequency can be guaranteed. In this case, when the temperature decreases, the operation frequency becomes unnecessarily high. However, because the increase of the operation frequency itself leads to an increased operation margin for the circuit, no problem arises.

Figure 8:
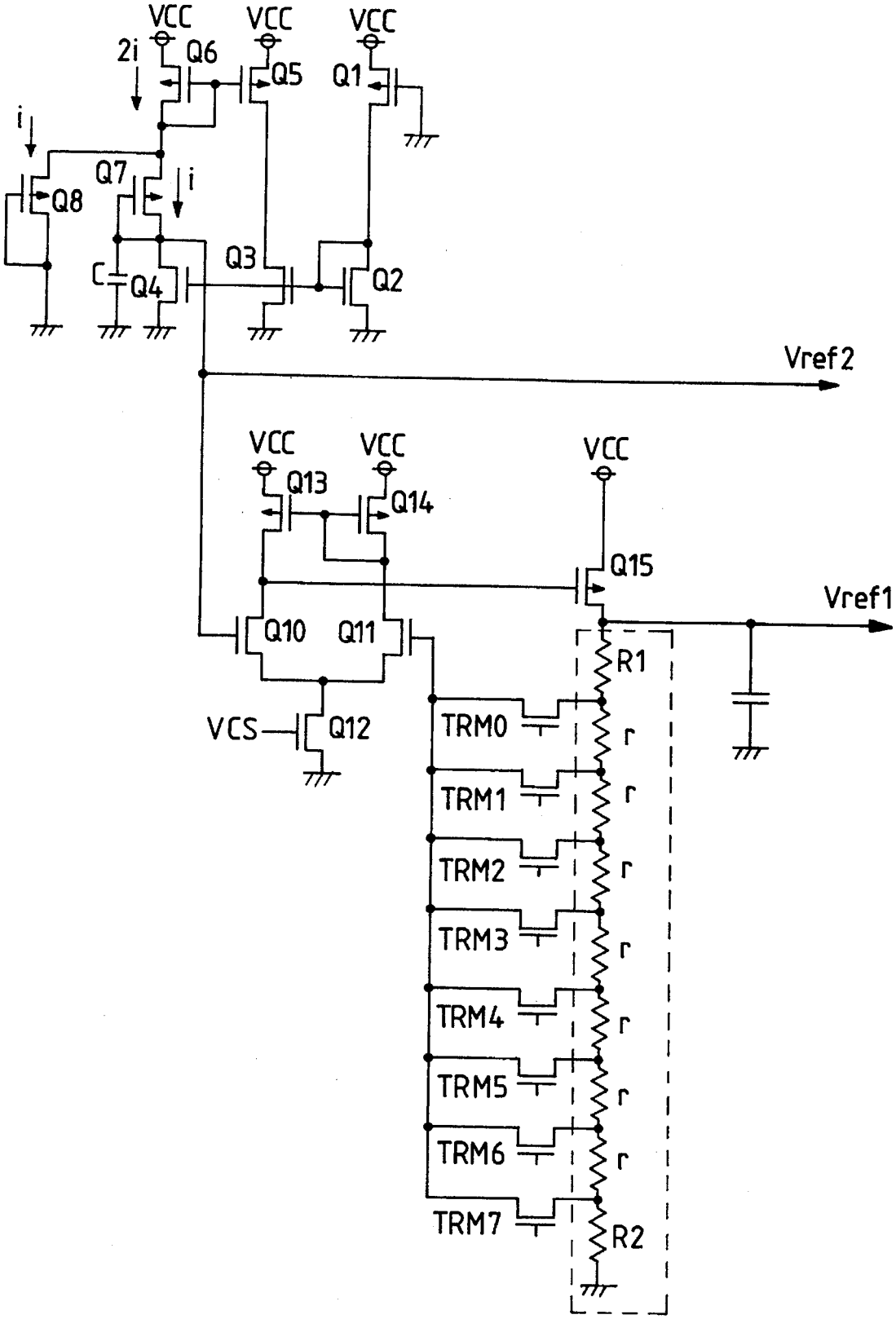
FIG. 8 is a block diagram showing another embodiment of the reference voltage generation circuit used in this invention.

FIG. 8 shows another embodiment of the reference voltage generation circuit used in this invention. In this embodiment, ΔVth is utilized as the reference voltage source.

A ground potential is applied to the gate of a p-channel MOSFET Q1 to form a-constant current, which is fed to an n-channel MOSFET Q2 of diode configuration. To this MOSFET Q2 are provided current mirror configured n-channel MOSFETs Q3 and Q4. The drain current of the MOSFET Q3 is converted into a push current by the current mirror circuit made up of p-channel MOSFETs Q5, Q6. At this time, through appropriate size setting of MOSFETs Q3 and Q4 or Q5 and Q6, the push constant current is set at 2i and the pull constant current of the MOSFET Q4 at i.

Between the MOSFET Q4 and the p-channel MOSFET Q6 is series-connected a p-channel MOSFET Q7 of diode configuration. And a p-channel MOSFET Q8 is provided between the connecting point of the MOSFETs Q6 and Q7 and the ground potential point of the circuit. This arrangement ensures that the same current i will flow through the two p-channel MOSFETs Q7, Q8 of diode configuration.

The MOSFET Q8 is doped with p-type impurities in its channel region by ion implantation so that the threshold voltage is increased in accordance with the amount of impurity. Because a difference is provided between the threshold voltages of the MOSFETs Q7 and Q8 while the same constant current i is passed through each of these MOSFETs, a reference voltage VREF that corresponds to the differential threshold voltage. Vth8–Vth7 between the MOSFETs Q8 and Q7 is produced from the source side of the MOSFET Q7. The differential voltage Vth8–Vth7 can be set accurately at about 1.1 V by the ion implantation technique.

Such a reference voltage VREF is, on one hand, used as the reference voltage Vref2 for the battery voltage detection circuit of FIG. 4 and, on the other hand, converted (or adjusted) into the reference voltage Vref1 for the voltage clamp circuit by the next DC amplifying circuit. The current mirror-configured p-channel MOSFETs Q13, Q14 that constitute the load circuit, the n-channel MOSFETs Q10, Q11 of differential configuration, and the constant current MOSFET Q12 that forms the operation current for the n-channel MOSFETs Q10, Q11 combine to form a differential amplifying circuit. The differential amplifying circuit is provided with an output p-channel MOSFET Q15.

The output signal of the output MOSFET Q15 is divided by the feedback resistors R1 and R2 and negative-fed back to the differential amplifying circuit. Trimming resistors r for fine adjustment are series-connected between the feedback resistors R1 and R2 to set the reference voltage Vref1 to an operation voltage that corresponds to the required operation frequency. Between each of junction points of the resistors and the feedback input of the differential amplifying circuit there are provided switch MOSFETs for trimming TRM0–TRM7. These switch MOSFETs TRM0–TRM7 are controlled by, in this case, cutting the fuse means.

When, for instance, an intermediate switch MOSFET TRM3 is turned on and the reference voltage Vref1 under this condition is higher than the target operation voltage, a step to be taken involves turning on a switch MOSFET TRM2 on the upper side to increase the feedback voltage, reduce the gain and thereby lower the reference voltage Vref1. By turning on the switch MOSFETs TRM1, TRM0, it is possible to further lower the reference voltage Vref1.

Conversely, if the reference voltage Vref1 when the intermediate switch MOSFET TRM3 is turned on is lower than the target operation voltage, a step to be taken involves turning on a switch MOSFET TRM4 on the lower side to reduce the feedback voltage, increase the gain and thereby raise the level of the reference voltage Vref1. Turning on the switch MOSFETs TRM5–7 causes the reference voltage Vref1 to increase further.

For reduced power consumption of the semiconductor integrated circuit, the combined resistance of the feedback resistors R1, r and R2 connected in series is set large. That is, to minimize the DC current flowing in the series resistor circuit, the combined resistance is set sufficiently large. Therefore, the circuit is easily affected by coupling. To prevent this, as shown by the dotted line, the resistor circuit is provided with a shield layer. The provision of such a shield layer allows signal lines to be deposited over where the high-resistance elements are formed.

Figure 9:
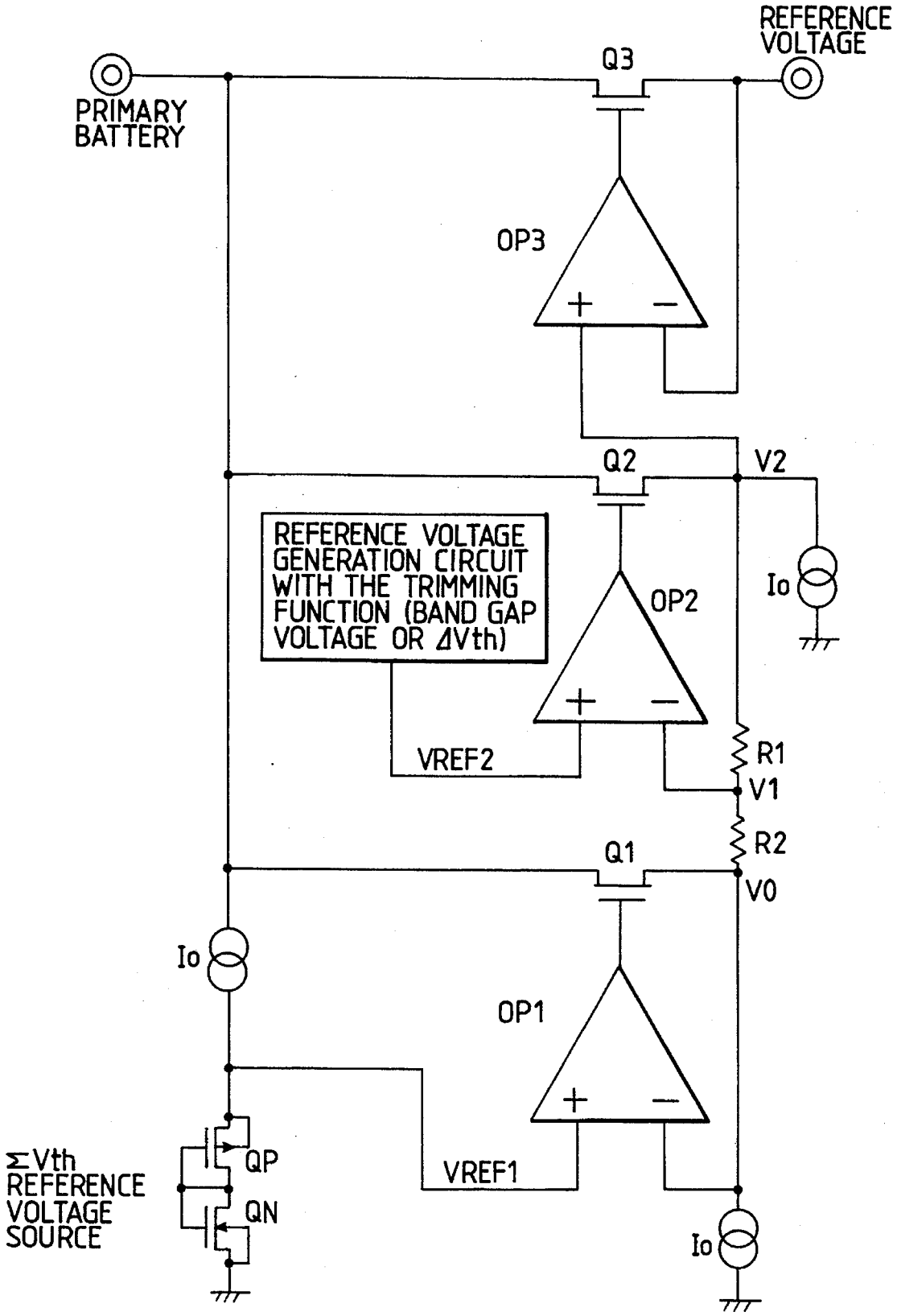
FIG. 9 is a block diagram showing still another embodiment of the reference voltage generation circuit used in this invention.

FIG. 9 is a block diagram showing another embodiment of the reference voltage generation circuit used in this invention. If, as in the case of FIG. 7 and FIG. 8, the reference voltage for voltage clamp that corresponds to the process variations is set to generate the operation voltage for LSI logic, the operation frequency will not fall below the required operation frequency fop even when the temperature lowers. That is, the operation frequency can be guaranteed. It is noted, however, that as the temperature decreases, the operation frequency becomes unnecessarily high and so does the current consumption.

To deal with this problem, the present inventors have considered that the power consumption of the circuit can be reduced by changing the operation voltage according to temperature changes while guaranteeing the operation frequency. That is, as shown in FIG. 6, as the temperature of the LSI logic formed of CMOS circuits rises, the required operation voltage to produce a desired operation frequency fop is increased. For this reason, the reference voltage supplied to the voltage clamp circuit is given a positive temperature coefficient so as to make the operation frequency almost constant at varying temperatures and thereby secure the operation margin, reducing the current consumption to a minimum required value.

The generating of the reference voltage with a positive temperature coefficient will now be described with reference to a detailed discussion of the embodiment of FIG. 9. In this embodiment, to automatically compensate for process variations of MOSFETs, the reference voltage source consists of a p-channel MOSFET QP and an n-channel MOSFET QN connected in series in the diode configuration so as to utilize ΣVth, the sum of the threshold voltages of the p-channel MOSFET QP and the n-channel MOSFET QN.

The MOSFETs QP and QN have almost the same threshold voltages as those of the p-channel MOSFET and n-channel MOSFET of the LSI logic formed on the same semiconductor substrate, and it is thus possible to form the reference voltage VREF1 that compensates for the process variations. A constant bias current is supplied from the constant current source Io to the MOSFETs QP and QN.

The reference voltage VREF1 is fed to the non-inverted input (+) of the operational amplifier OP1, while its inverted input (–) is supplied a voltage V0, which is a primary battery voltage shifted in level by the MOSFET Q1 as a variable resistance element. Because the constant current Io is passed through the MOSFET Q1, the battery voltage is shifted in level according to the resistance of the MOSFET Q1. The operational amplifier OP1 controls the on-resistance value of the MOSFET Q1 so that the both inputs VREF1 and V0 match.

The voltage V0 corresponding to the reference voltage VREF1 is fed to one end of a resistor R2, which is directly connected with a resistor R1. The junction point between the resistors R1 and R2 is supplied a voltage V1, which is further supplied to one input (–) of an operational amplifier OP2. The other input (+) of the operational amplifier OP2 is supplied a reference voltage VREF2, which is formed by the reference voltage generation circuit with the trimming function. The reference voltage VREF2 is made a constant voltage such as the silicon band gap voltage and AVth that have no temperature dependency. The MOSFET Q2 is connected in series with the resistor R1 and is supplied a constant current from the constant current source Io.

The operational amplifier OP2 controls the MOSFET Q2 so that the reference voltage VREF2 and the voltage V1 are equal. A Current corresponding to the voltage difference between the voltages V1 and V0 flows through the resistor R2. As described above, the voltage V1, like the reference voltage VREF2, does not have a temperature dependency, whereas the voltage V0, like ΣVth, has a negative temperature coefficient. Therefore, a current having a positive temperature coefficient flows through the resistor R2. This current also flows into the resistor R1 from one end, so that the resistor, R1 produces a voltage V2 having a positive temperature dependency at the other end, with the constant voltage V1 having no temperature dependency taken as a reference.

The voltage V2 is fed to the non-inverted input (+) of an operational amplifier OP3, whose inverted input (–) is supplied the reference voltage. The operational amplifier OP3 controls a MOSFET Q3 as a variable resistance element so that both inputs agree, producing the reference voltage from the primary battery voltage. In this configuration, since the voltage V2 has a positive temperature dependency, the reference voltage thus produced will increase as the temperature rises.

In this embodiment, during the probing at normal temperature, the operation voltage corresponding to the required operation frequency is measured and the reference voltage VREF2 is set by fuse trimming. The voltage V1 is set following the voltage VREF1. The voltage V1 is added with a voltage generated by the resistor R1 and having a positive temperature coefficient, to produce a voltage V2. As a result, over the entire service temperature range, the operation voltage of the LSI logic changes to produce a desired operation frequent, minimizing the current consumption.

Figure 10:
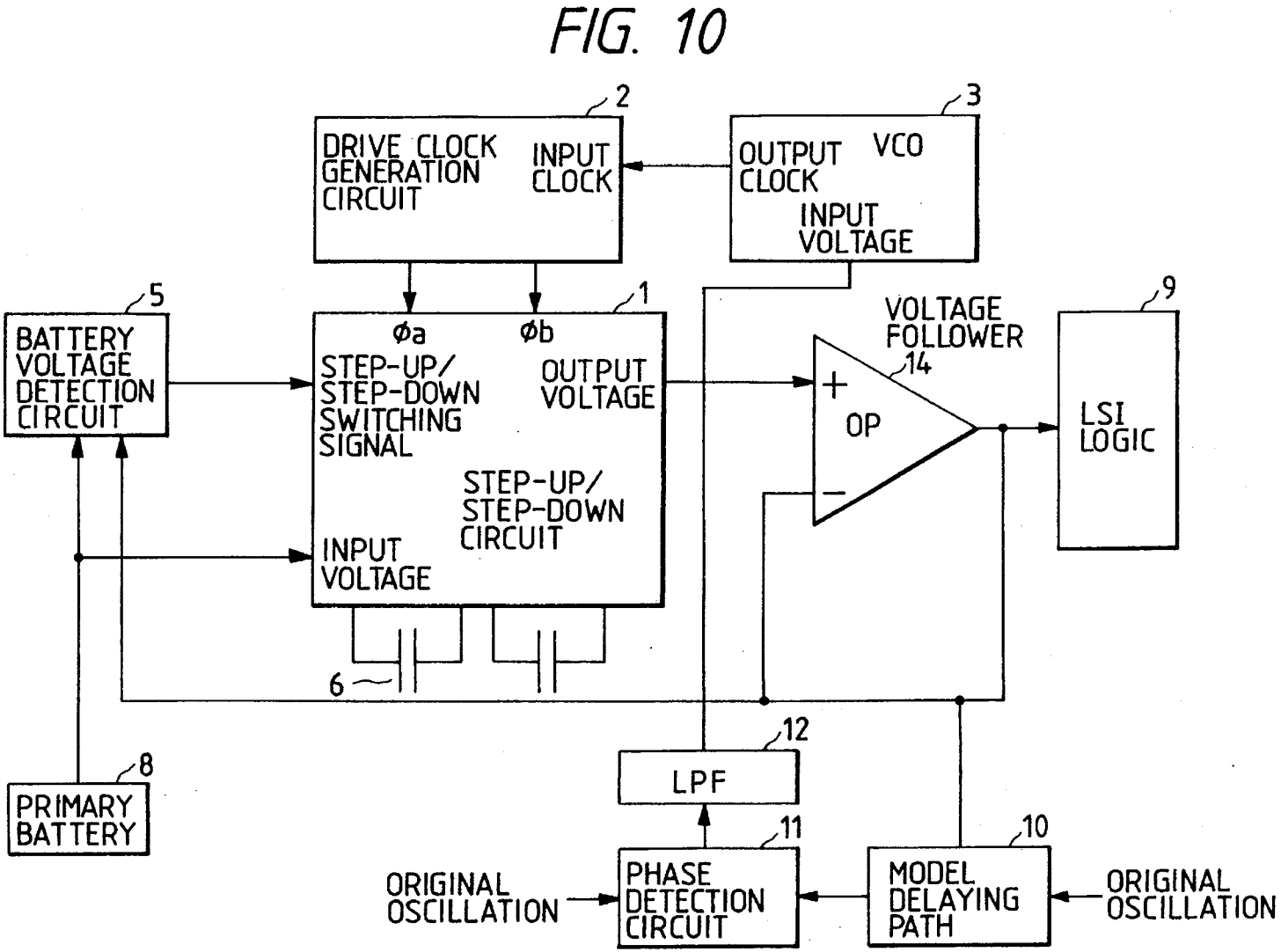
FIG. 10 is a block diagram showing another embodiment of the power supply circuit incorporated in the semiconductor integrated circuit device of this invention.

FIG. 10 shows a block diagram of another embodiment of the power supply circuit built into the semiconductor integrated circuit device according to this invention. In this embodiment, the operation frequency itself of the LSI logic is detected directly to control the operation voltage and thereby produce a desired operation frequency, rather than stabilizing the operation frequency indirectly, so to speak, by controlling the operation voltage according to the temperature dependency of the LSI logic as mentioned earlier.

In this embodiment, the output voltage of the step-up/step-down circuit 1 is provided as the operation voltage for the LSI logic through a voltage follower circuit 14 which uses an operational amplifier OP that works as a current amplifying circuit. Because this embodiment has no voltage clamp circuit 4 mentioned before, the operation voltage setting is done by the following feedback circuit for the step-up/step-down circuit 1.

The original oscillation is a reference frequency signal generated by an oscillation circuit using a crystal oscillator. This frequency is made equal to the operation frequency required of the LSI logic 9. A model delay path 10 is a logic gate circuit consisting of an inverter circuit made of the same MOSFETs as used in the LSI logic. The model delay path 10 is operated by the same operation voltage as the LSI logic 9.

The original oscillation and the delayed oscillation that has passed through the model delay path 10 are sent to the phase detection circuit 11, which produces a phase detection signal corresponding to the model delay path. The phase detection signal is converted into a DC signal by the low-pass filter (LPF) 12 and then supplied to the control terminal of the VCO 3 as an input voltage. The phase detection circuit 11 increases the detection signal as the delay time of the model delay path 10 becomes greater than the target value, in other words, as the operation frequency of the LSI logic decreases due to process variations and temperature changes. This in turn increases the control voltage of the VCO 3, increasing the input clock frequency entered into the drive clock generation circuit.

Conversely, when the delay time of the model delay path 10 becomes shorter than the target value due to process variations and temperature changes, in other words when the operation frequency of the LSI logic increases, the phase detection circuit 11 reduces the detection signal accordingly. This reduces the control voltage of the VCO 3, lowering the input clock frequency entered into the drive clock generation circuit 2. As a result, the step-up/step-down circuit 1 adjusts the output voltage according to the frequency of the clock pulses $\phi a$, $\phi b$. With this feedback loop, the delay time of the model delay path 10 is automatically controlled to the target value.

Figure 11A:
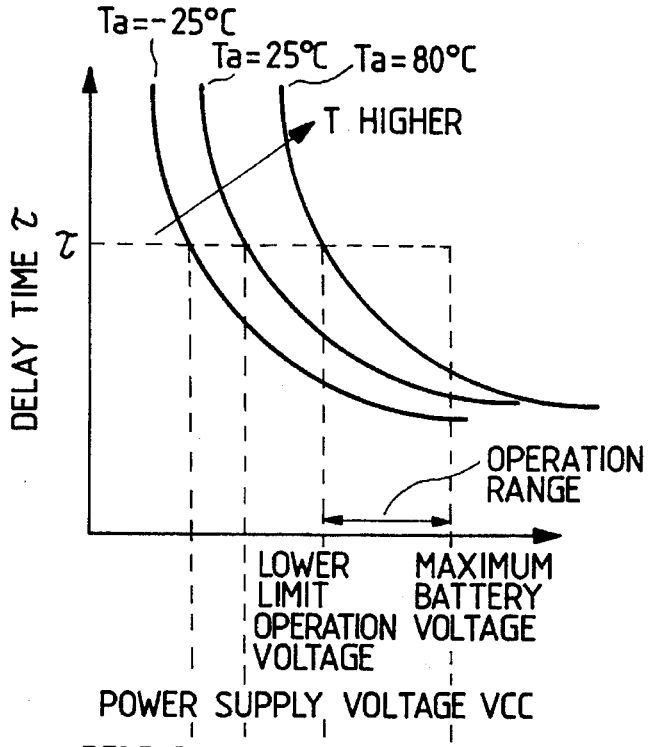
FIGS. 11(A) and 11(B) are characteristic diagrams showing the dependency of the delay time and of the operation frequency on power supply, respectively.
Figure 11B:
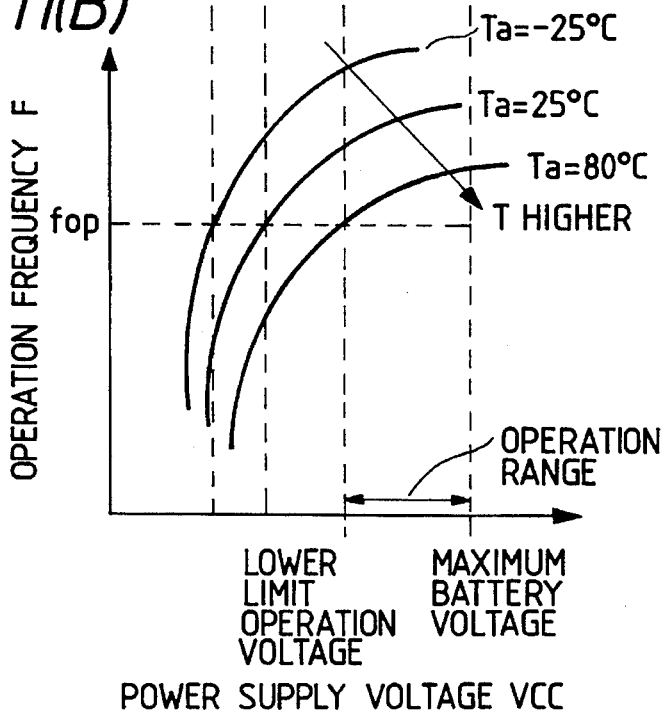

FIG. 11(A) shows the dependency on ambient temperature and power supply of the delay time in the model delay path, and FIG. 11(B) shows the dependency on the ambient temperature and power supply of the operation frequency. The operation frequency F and the delay time $\tau$ are in a reciprocal relationship with each other, and thus the temperature characteristics have inverse inclinations. In the embodiment of FIG. 10, because the delay time $\tau$ and the operation frequency F are virtually the same, the delay time $\tau$ is detected by the model delay path 10 and the operation voltage of the LSI logic is set accordingly.

Figure 12:
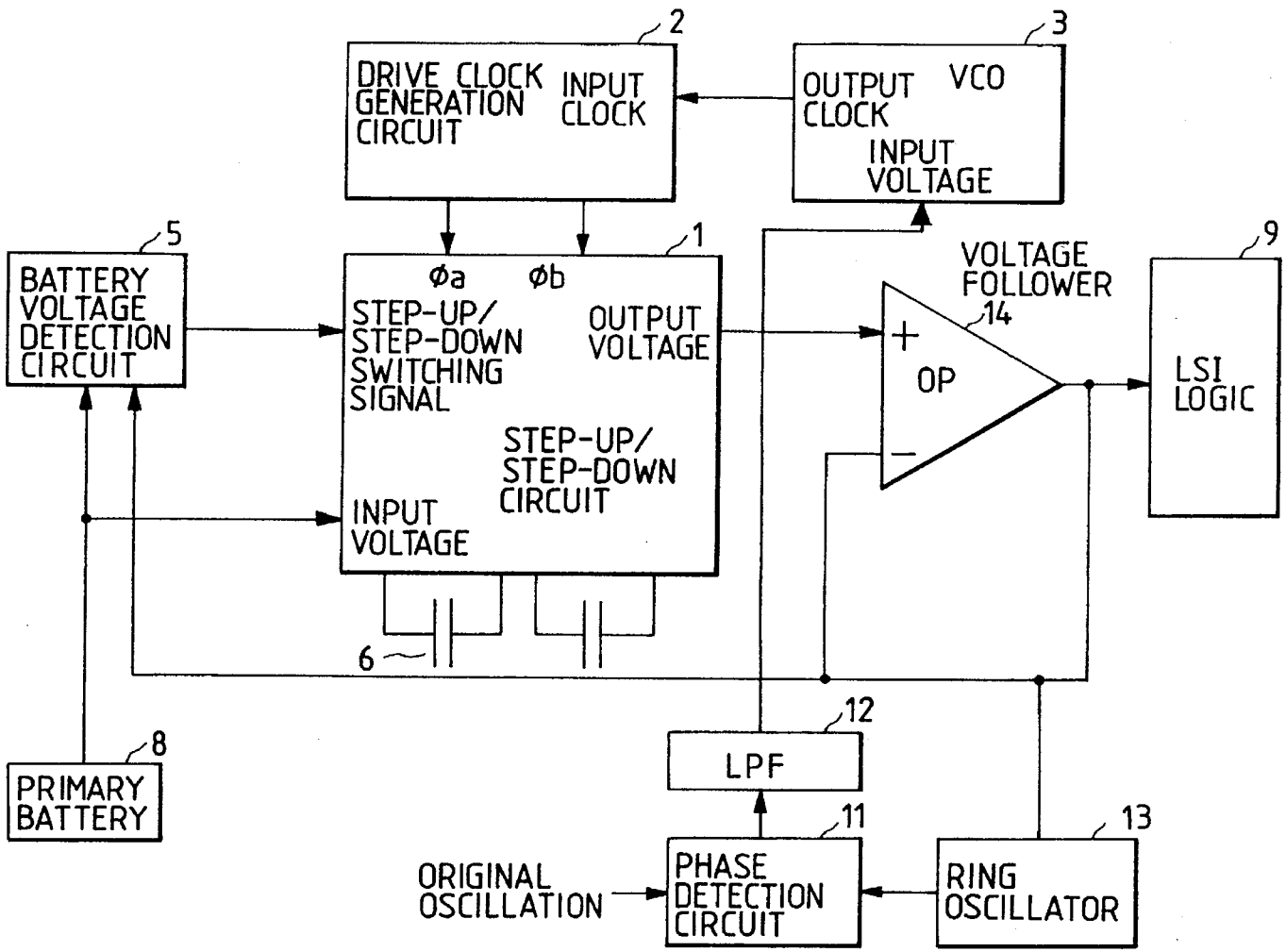
FIG. 12 is a block diagram showing still another embodiment of the power supply circuit incorporated in the semiconductor integrated circuit device of this invention.

FIG. 12 shows a block diagram of a further embodiment of the power supply circuit built into the semiconductor integrated circuit device according to this invention. This embodiment employs a ring oscillator 13 in place of the model delay path of the preceding embodiment and sends its oscillation frequency and the original oscillation to the phase detection circuit (frequency comparison circuit) to detect the operation frequency of the LSI logic and control the operation voltage so as to obtain the desired operation frequency more directly. That is, the operation voltage is controlled according to the characteristic diagram of FIG. 11(B) so that the operation frequency fop will be the desired frequency. The ring oscillator 13 is comprised of an inverter circuit formed of the same MOSFETs as used in the LSI logic, and is operated by the same operation voltage as the LSI logic 9.

The phase detection circuit 11 increases the detection signal as the oscillation frequency of the ring oscillator 13 becomes lower than the original oscillation frequency due to process variation and temperature changes, in other words, as the operation frequency of the LSI logic is lowered. As a result, the control voltage of the VCO 3 is increased, increasing the frequency of the input clock frequency supplied to the drive clock generation circuit. Conversely, when the oscillation frequency of the ring oscillator 13 is higher than the original oscillation frequency due to process variations and temperature changes, in other words, when the operation frequency of the LSI logic increases, the phase detection circuit 11 reduces the detection signal accordingly. This in turn lowers the control voltage of the VCO 3, reducing the input clock frequency fed to the drive clock generation circuit 2. As a result, the step-up/step-down circuit 1 adjusts the output voltage according to the frequency of the clock pulses $\phi a$, $\phi b$. With this feedback loop, the oscillation frequency of the ring oscillator 13 is automatically controlled to match the original oscillation frequency, the target value.

Figure 13:
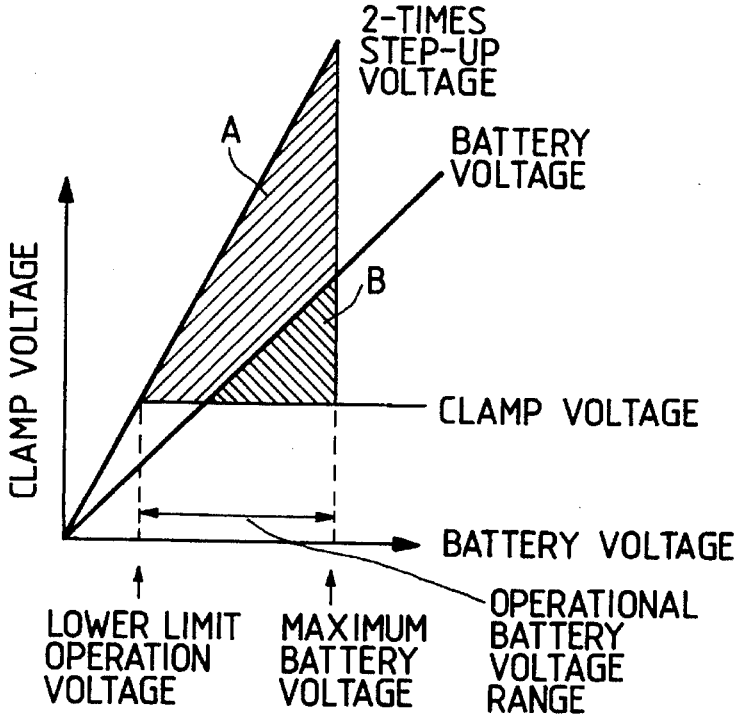
FIG. 13 is a characteristic diagram showing the relation between the battery voltage and the clamp voltage.

With the above-mentioned method that steps up or steps down the voltage of the primary battery by using the step-up/step-down circuit 1 and feeds it to the power supply circuit, it is possible to reduce the current consumption of the power supply circuit itself. That is, as shown in FIG. 13, when the LSI logic's operation voltage is formed by clamping the battery voltage itself, the operation of the LSI logic can be stabilized by the regulated power supply and its current consumption reduced. When, however, the battery voltage decreases to near the clamp voltage, the LSI logic is unable to operate.

When, on the other hand, the two-times step-up circuit is incorporated, the battery life can be extended into a lower battery voltage range. However, because the shaded portions A and B in the diagram represent the electric power consumed by the MOSFET which works as a variable resistance element in the voltage clamp circuit, the overall power consumption is not reduced. That is, where the battery voltage is utilized as is, the portion B is consumed by the variable resistance element. Where the two-times step-up circuit is used, the portions A+B are consumed by the variable resistance element, lowering the usable battery voltage. But the power A+B consumed by the variable resistance element accelerates the reduction in the battery voltage. As a result, the battery life span for the case where the battery voltage is used as is, is virtually equal to that when the two-times step-up circuit is used.

On the other hand, where the step-up/step-down circuit 1 is used as in this embodiment, because the battery voltage, when it is sufficiently high, can be stepped down to obtain the desired operation voltage and lower the power consumed by the variable resistance element, the virtual battery life can be elongated.

Figure 14:
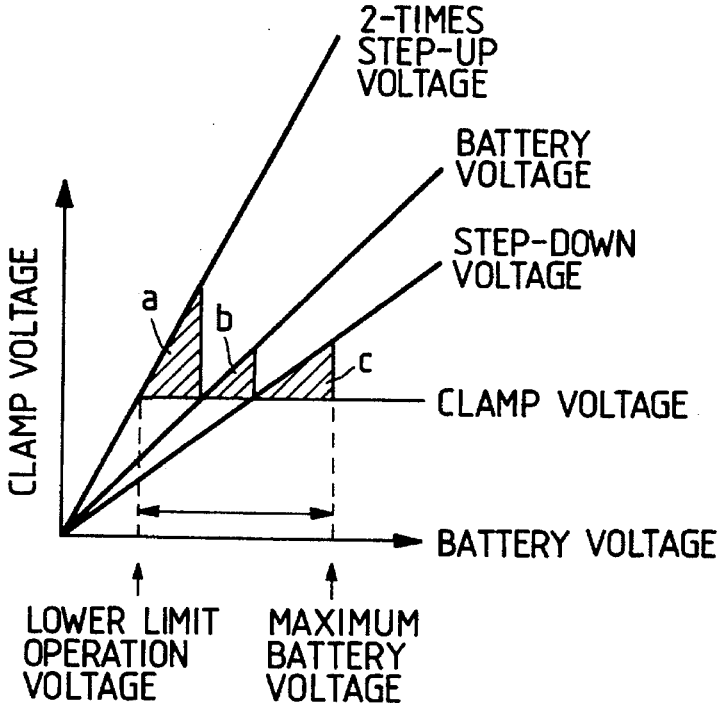
FIG. 14 is a characteristic diagram showing the relation between the battery voltage and the clamp voltage, presented to explain the operation of the power supply circuit of this invention.

FIG. 14 shows the method of further elongating the battery life. For example, in the embodiment of FIG. 4, the battery voltage detection circuit is made to detect two battery voltages. When the stepped down voltage is reduced to near the clamp voltage, the step-down operation is stopped and the switches S1 and S3 are turned on to output the battery voltage as is. That is, the detection signal also causes the VCO 3 to stop and both of the drive clocks $\phi a$, $\phi b$ to go high, and the switches S1 and S3 to turn on. Then, when the battery voltage decreases to near the clamp voltage, the step-up circuit is operated to output the stepped-up voltage.

When the step-up/step-down circuit 1 is made to perform three ways of output operation, the shaded portions c, b and a in FIG. 14 represent the power consumed by the variable resistance element that performs the above-mentioned voltage clamp operation. The reduction in the reactive power further prolongs the virtual battery life.

For the voltage clamp operations, the reference voltages used to activate the step-down operation, the battery voltage output, and the step-up operation are increased from the clamp voltage by a sufficient margin for the MOSFET to operate.

Figure 15:
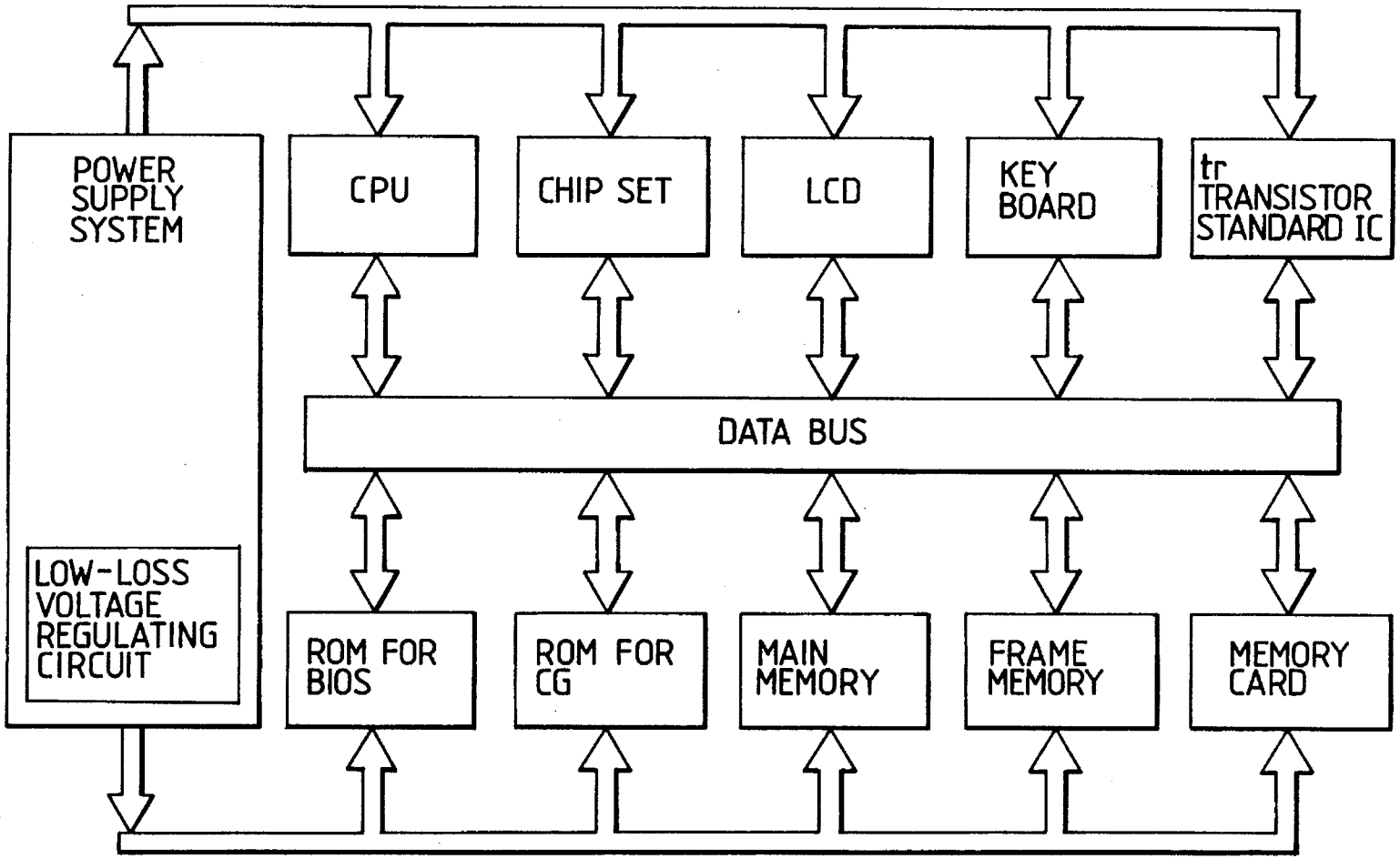
FIG. 15 is a block diagram showing one embodiment of a notebook type personal computer employing the semiconductor integrated circuit device of this invention.

FIG. 15 shows a block diagram of one embodiment of a notebook type personal computer using the semi-conductor integrated circuit device of this invention. The semiconductor integrated circuit devices, such as central processing unit, various types of memory (BIOS ROM, CG ROM, main memory and frame memory) and RAM chips mounted on the memory card as an external memory, each have a built-in power supply circuit to convert the power supply voltage fed from the power supply system into internal voltages corresponding to respective operation frequencies. Where a voltage for display different from those used for signal processing and transmission is required as in the liquid crystal display apparatus, the display operation is powered by the voltage from the power supply system.

For the apparatuses that can be operated also by the battery voltage, such as notebook type personal computers, the power supply system is provided with the above-mentioned power supply circuit. When the notebook type personal computer is driven by a battery, the low-loss voltage regulating circuit is operated to perform the step-up/step-down operation according to the present battery voltage and to change the frequency of the clock pulse according to the load current, thereby elongating the battery life.

Where signal transfer among semiconductor integrated circuit devices is performed through data bus, the signal levels must be equal. For this reason, the interfaces of these semiconductor integrated circuit devices are operated not by the operation voltages formed by the built-in power supply circuits but by the same voltage formed by the power supply system. Thus, in these semiconductor integrated circuit devices the interfaces are provided with a level conversion function to allow the signal transfer between the internal circuits.

The advantages brought about by the above embodiments may be summarized as follows.

(1) By generating the power supply voltage that corresponds to the operation speed required of the internal circuit formed of MOSFET by using the built-in power supply circuit, it is possible to prevent an increase in the current consumption that would result if the operation speed is raised to an unnecessarily high level.

(2) The fact that the above-mentioned power supply circuit provides the threshold voltage of MOSFETs with a positive temperature dependency makes it possible to set an almost constant operation frequency even under the conditions of process variations and temperature changes.

(3) Because the power supply circuit forms a power supply voltage that enables the logic gate circuit to have a desired delay time, it is possible to set an almost constant operation frequency more directly when there are process variations and temperature changes. This in turn stabilizes the operation margin and reduces the power consumption.

(4) When the power supply voltage externally supplied to the power supply circuit is a battery voltage, a voltage conversion circuit is used which selectively performs the step-up and step-down operations on the battery voltage using the capacitor and timing pulse. At the same time the frequency of the timing pulse fed to the voltage conversion circuit is controlled according to the load current. As a result, the current consumed by the power supply circuit can be reduced.

(5) Semiconductor integrated circuit devices with such a power supply circuit are provided with an interface circuit having a level conversion function so that a plurality of semiconductor integrated circuit devices can be combined to form a system. This assures versatility of the semiconductor integrated circuit devices while at the same time reducing power consumption and stabilizing the operation margin.

(6) The power feeding method, which supplies an operation voltage to the internal circuit by using a power supply voltage corresponding to the required operation speed, prevents an increase in the current consumption that would result if the operation speed of the semiconductor integrated circuit is raised to an unnecessarily high level.

The present invention has been described in conjunction with several embodiments. It is noted, however, that the invention is not limited to these embodiments but that various modifications may be made without departing from the spirit of the invention. For example, in the embodiments of FIG. 4, 10 or 12, the VCO may be applied a reference voltage that sets the reference frequency so that the operation frequency changes according to the input voltage with respect to the reference frequency. In FIG. 10 and 12, it is also possible to supply the battery voltage detection circuit 5 with a reference voltage such as ΔVth that has no temperature dependency to perform the step-up or step-down operation according to the exhaustion level of the battery.

In the embodiment of FIG. 10 or 12, the original oscillation may use an appropriate system clock pulse that exists in the system on which the original oscillation is mounted. Further, it is possible to form a DC voltage by the output signal of the phase comparison circuit 11 and activate the voltage clamp circuit according to the DC voltage to generate the output voltage supplied to the LSI logic. In this case, the input voltage to the VCO may use the output voltage of the step-up/step-down circuit 1 as in the case of the embodiment of FIG. 3.

This invention has a wide range of applications for the semiconductor integrated circuit devices formed of MOSFETs.

A representative advantage of this invention may be briefly summarized as follows. Because the power supply circuit is built into the semiconductor integrated circuit device and the operation voltage corresponding to the operation speed required of the internal circuit is formed, the internal circuit can be operated at the minimum required voltage even when there are process variations and temperature changes, thus realizing the rational power supply.

What is claimed is:

1. A semiconductor integrated circuit device formed on a single semiconductor chip, comprising:

an external power supply terminal connected with a battery as an external power supply;

an internal circuit including a plurality of MOSFETs; and an internal power supply means connected to said external power supply terminal and providing on the basis of said external power supply an operation voltage to be supplied to said internal circuit, wherein said internal power supply means includes:

detection means connected to said external power supply terminal to detect a voltage of said battery;

voltage conversion means to selectively perform a step-up or step-down operation on the battery voltage, said voltage conversion means including a selection function to select one of the step-up and step-down operations according to a detection signal outputted from said detection means and a conversion execution function to execute a selected operation in response to a clock signal;

supply means to supply as the operation voltage to said internal circuit a voltage which is responsive to a voltage outputted from said voltage conversion means;

clock signal generation means to form said clock signal supplied to said voltage conversion means; and control means connected to said clock signal generation means to control a frequency of the generated clock signal so that the operation voltage outputted from said supply means conforms to an internal power supply voltage for achieving an operation speed required of said internal circuit.

2. A semiconductor integrated circuit device according to claim 1, wherein said control means is coupled to receive a reference voltage from a reference voltage generation means and includes means to change a frequency of the clock signal formed by the clock signal generation means according to a potential difference between the reference voltage and the voltage outputted from said voltage conversion means.

3. A semiconductor integrated circuit device according to claim 2, wherein the reference voltage generation means includes a plurality of MOSFETs, powered by the battery voltage, connected in a manner in which the reference voltage is attained on a basis of a difference in threshold voltage of the MOSFETs.

4. A semiconductor integrated circuit device according to claim 2, wherein said reference voltage generation means forms, from the battery voltage, a voltage having a positive temperature dependency and outputs it as the reference voltage.

5. A semiconductor integrated circuit device according to claim 1, wherein said control means includes a gate circuit that receives a signal of a specified frequency and is driven by the operation voltage outputted from said supply means, and means to change a frequency of the clock signal formed by said clock signal generation means according to a phase difference between the output signal of said gate circuit and said signal of a specified frequency.

6. A semiconductor integrated circuit device according to claim 1, wherein said control means includes an oscillation circuit that is driven by the operation voltage outputted from said supply means, and means to change a frequency of the clock signal formed by said clock signal generation means according to a phase difference between an output signal of said oscillation circuit and a signal of a specified frequency.

7. A semiconductor integrated circuit device according to claim 1, wherein said supply means includes a voltage follower circuit that receives the voltage outputted from said voltage conversion means and outputs said operation voltage.

8. A semiconductor integrated circuit device according to claim 1, wherein said supply means includes a voltage clamp circuit that receives the voltage outputted from said voltage conversion means and outputs the operation voltage.

9. A semiconductor integrated circuit device according to claim 2, wherein said supply means includes a voltage clamp circuit that clamps the voltage outputted from said voltage conversion means to a voltage that corresponds to the reference voltage generated by said reference voltage generation means.

* * * * *